US009343024B2

(12) United States Patent
Lee et al.

(10) Patent No.: US 9,343,024 B2
(45) Date of Patent: May 17, 2016

(54) LIQUID CRYSTAL DISPLAY APPARATUS AND A DRIVING METHOD THEREOF

(71) Applicant: SAMSUNG DISPLAY CO., LTD., Yongin, Gyeonggi-Do (KR)

(72) Inventors: Kwangkeun Lee, Osan-si (KR); Hyun Min Cho, Seoul (KR); Jae Byung Park, Seoul (KR); Jaehyun Cho, Seoul (KR); Sung-Jin Hong, Hwaseong-si (KR); Seon-Tae Yoon, Seoul (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 0 days.

(21) Appl. No.: 14/325,792

(22) Filed: Jul. 8, 2014

(65) Prior Publication Data

US 2015/0194104 A1 Jul. 9, 2015

(30) Foreign Application Priority Data

Jan. 3, 2014 (KR) ..... 10-2014-0000884

(51) Int. Cl.

| | |
|---|---|
| ***G09G 3/36*** | (2006.01) |
| ***G09G 3/34*** | (2006.01) |
| ***G09G 5/10*** | (2006.01) |

(52) U.S. Cl.

CPC ..... *G09G 3/3607* (2013.01); *G09G 3/3413* (2013.01); *G09G 3/3659* (2013.01); *G09G 3/3685* (2013.01); *G09G 5/10* (2013.01); *G09G 2310/0235* (2013.01); *G09G 2320/0233* (2013.01); *G09G 2320/0252* (2013.01); *G09G 2320/0271* (2013.01);

(Continued)

(58) Field of Classification Search

CPC ..... G09G 5/10; G09G 3/3659; G09G 3/3607; G09G 3/3413; G09G 3/3685; G09G 2320/04; G09G 2320/0233; G09G 2330/021; G09G 2310/0235; G09G 2320/0252; G09G 2320/0271; G09G 2320/0276; G09G 2360/145

See application file for complete search history.

(56) References Cited

U.S. PATENT DOCUMENTS 7,903,128 B2 * 3/2011 Ko ..... G09G 5/06 345/690

2001/0052891 A1 12/2001 Yoshihara et al.

(Continued)

FOREIGN PATENT DOCUMENTS

| | | |
|---|---|---|
| EP | 2211329 | 7/2010 |
| KR | 1020070100992 | 10/2007 |
| KR | 1020080021344 | 3/2008 |

*Primary Examiner* — Christopher E Leiby

(74) *Attorney, Agent, or Firm* — F. Chau & Associates, LLC

(57) ABSTRACT

A method of driving a liquid crystal display apparatus includes gamma-correcting first and second gray scale data using a first gamma value to generate first and second luminance data; generating sub luminance data based on a smaller value of the first and second luminance data; correcting the sub luminance data using a second gamma value larger than the first gamma value to generate sub correction luminance data; correcting the first luminance data using the sub or second luminance data to generate first correction luminance data; correcting the second luminance data using the sub or first luminance data to generate second correction luminance data; performing inverse gamma correction on the first, second and sub correction luminance data using the first gamma value to generate first, second and sub correction gray scale data; and providing first to third pixels with the first, second, and sub correction gray scale data.

21 Claims, 7 Drawing Sheets

(52) U.S. Cl.
CPC ... *G09G 2320/0276* (2013.01); *G09G 2320/04* (2013.01); *G09G 2330/021* (2013.01); *G09G 2360/145* (2013.01)

(56) References Cited

U.S. PATENT DOCUMENTS

2002/0176024 A1* 11/2002 Kao ..... H04N 5/202 348/674
2005/0057472 A1* 3/2005 Lee ..... G09G 3/2092 345/89
2005/0162352 A1* 7/2005 Lee ..... G09G 3/2022 345/63
2006/0044231 A1* 3/2006 Seki ..... G09G 3/2055 345/76
2006/0066515 A1* 3/2006 Han ..... G09G 3/293 345/60
2007/0139326 A1* 6/2007 Kwon ..... G09G 3/3607 345/88
2009/0128883 A1* 5/2009 Endo ..... G02B 26/0841 359/290
2010/0039453 A1* 2/2010 Chaji ..... G09G 3/20 345/690
2010/0214310 A1* 8/2010 Kuwahara ..... G09G 5/02 345/590
2010/0265281 A1* 10/2010 Furukawa ..... G09G 3/3413 345/691
2011/0043547 A1* 2/2011 Nonaka ..... G09G 3/3426 345/690
2012/0002133 A1* 1/2012 Yamazaki ..... G09G 3/342 349/61
2013/0076864 A1* 3/2013 Takahashi ..... G09G 3/003 348/46
2013/0201223 A1* 8/2013 Li ..... G09G 3/2022 345/690
2013/0215360 A1* 8/2013 Pollack ..... G09G 3/3413 349/61
2014/0146090 A1* 5/2014 Oh ..... G09G 3/20 345/690
2014/0152724 A1 6/2014 Park et al.
2015/0187263 A1* 7/2015 Yang ..... G09G 3/2011 345/212
2015/0194117 A1* 7/2015 Cho ..... G09G 3/3685 345/691

* cited by examiner

LIQUID CRYSTAL DISPLAY APPARATUS AND A DRIVING METHOD THEREOF

CROSS-REFERENCE TO RELATED APPLICATION

This application claims priority under 35 U.S.C. §119 to Korean Patent Application No. 10-2014-0000884 filed Jan. 3, 2014, in the Korean Intellectual Property Office, the disclosure of which is incorporated by reference herein in its entirety.

TECHNICAL FIELD

The inventive concept relates to a display apparatus, and more particularly, to a liquid crystal display apparatus and a driving method thereof.

DISCUSSION OF THE RELATED ART

In general, a liquid crystal display apparatus expresses full color using a space division method. This is accomplished with a liquid crystal display panel in which red, green, and blue color filters are arranged spatially and iteratively to correspond to sub pixels.

In contrast to the space division method, in a time division or field sequential method, a liquid crystal display apparatus expresses full color with high transmittance and low fabricating cost. With the time division method, a color filter is removed from the liquid crystal display panel, and a backlight that is disposed on the back side of the liquid crystal display panel includes red, green, and blue light sources for emitting red, green, and blue color lights. In addition, a frame is temporally divided into three fields. As the red, green, and blue light sources are turned on during the three fields, red, green, and blue color images are sequentially expressed. A viewer recognizes a full-color image in which red, green, and blue color images become one by way of their physiological visual sense.

SUMMARY

An exemplary embodiment of the inventive concept provides a method of driving a liquid crystal display apparatus which includes a liquid crystal display panel including a first pixel having a first color filter, a second pixel having a second color filter having a color different from a color of the first color filter, and a third pixel having a transmission portion, the method comprising: providing the liquid crystal display panel with a first color light having a first color and a second color light having a second color different from the first color during a first field and a second field of a time-divided frame; gamma-correcting first and second gray scale data received from an external device using a first gamma value to generate first and second luminance data; generating sub luminance data based on a smaller value of the first and second luminance data; correcting the sub luminance data using a second gamma value larger than the first gamma value to generate sub correction luminance data; correcting the first luminance data using the sub luminance data or the second luminance data to generate first correction luminance data; correcting the second luminance data using the sub luminance data or the first luminance data to generate second correction luminance data; inverse gamma-correcting the first and second correction luminance data and the sub correction luminance data using the first gamma value to generate first and second correction gray scale data and sub correction gray scale data; and providing the first pixel, second pixel, and third pixel with the first correction gray scale data, second correction gray scale data, and sub correction gray scale data during the first field.

In an exemplary embodiment of the inventive concept, the sub correction luminance data is generated by:

$$SC=Min^{\gamma 2/\gamma 1},$$

where "SC" is the sub correction luminance data, "Min" is the sub luminance data, "γ1" is the first gamma value, and "γ2" is the second gamma value.

In an exemplary embodiment of the inventive concept, the first and second gamma values satisfy a condition: $1.2<\gamma 2/\gamma 1<2$, where "γ1" is the first gamma value, and "γ2" is the second gamma value.

In an exemplary embodiment of the inventive concept, the first correction luminance data is $RC=RL\times(1-GL)+Min$ and the second correction luminance data is $GC=GL\times(1-RL)+Min$, where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is $RC=RL\times(1-Min)+Min$ and the second correction luminance data is $GC=GL\times(1-Min)+Min$, where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is $RC=RL\times 2-RL(1+Min)$ and the second correction luminance data is $GC=GL\times 2-GL(1+Min)$, where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is $RC=RL\times 2-RL(1+GL)$ and the second correction luminance data is $GC=\times 2-GL(1+RL)$, where "RC" is the first correction luminance data, "GC" is the second correction luminance data, "Min" is the sub luminance data, "RL" is the first luminance data, and "GL" is the second luminance data.

In an exemplary embodiment of the inventive concept, the method further comprises gamma-correcting third gray scale data received from the external device using the first gamma value to generate third luminance data; correcting the third luminance data based on the sub luminance data to generate third correction luminance data; performing inverse gamma-correcting on the third correction luminance data to generate third correction gray scale data; and providing the third pixel with the third correction gray scale data during the second field.

In an exemplary embodiment of the inventive concept, the third correction luminance data is $RC=0.5\times BL\times(1+Min)$, where "RC" is the third correction luminance data, "BL" is the third luminance data, and "Min" is the sub luminance data.

In an exemplary embodiment of the inventive concept, an intensity of the second color light is greater than an intensity of the first color light.

In an exemplary embodiment of the inventive concept, the first color light is a yellow light and the second color light is a blue light.

In an exemplary embodiment of the inventive concept, the first color filter transmits a red light and the second color filter transmits a green light.

In an exemplary embodiment of the inventive concept, the method further comprises providing the first and second pixels with the first and second correction gray scale data during the second field.

An exemplary embodiment of the inventive concept provides a liquid crystal display apparatus comprising: a backlight unit configured to output a first color light with a first color and a second color light with a second color different from the first color during a first field and a second field of a time-divided frame; a liquid crystal display panel configured to display an image corresponding to the frame and including a first pixel having a first color filter, a second pixel having a second color filter having a color different from a color of the first color filter, and a third pixel having a transmission portion; and a gamma mapping unit. The gamma mapping unit comprises a gamma correction unit configured to gamma-correct first and second gray scale data received from an external device using a first gamma value to generate first and second luminance data; a sub luminance data generation unit configured to generate sub luminance data based on a smaller value of the first and second luminance data; a first correction unit configured to correct the sub luminance data using a second gamma value larger than the first gamma value to generate sub correction luminance data; a second correction unit configured to correct the first luminance data using the sub luminance data or the second luminance data to generate first correction luminance data and to correct the second luminance data using the sub luminance data or the first luminance data to generate second correction luminance data; and an inverse gamma correction unit configured to perform inverse gamma correction on the first and second correction luminance data and the sub correction luminance data using the first gamma value to generate first and second correction gray scale data and sub correction gray scale data. The gamma mapping unit provides the first pixel, second pixel, and third pixel with the first correction gray scale data, second correction gray scale data, and sub correction gray scale data during the first field.

In an exemplary embodiment of the inventive concept, the sub correction luminance data is generated by:

$$SC=Min^{\gamma 2/\gamma 1}$$

, where "SC" is the sub correction luminance data, "Min" is the sub luminance data, "γ1" is the first gamma value, and "γ2" is the second gamma value.

In an exemplary embodiment of the inventive concept, the first correction luminance data is RC=RL×(1−GL)+Min and the second correction luminance data is GC=GL×(1−RL)+Min, where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is RC=RL×(1−Min)+Min and the second correction luminance data is GC=GL×(1−Min)+Min, where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is RC=RL×2−RL(1+Min) and the second correction luminance data is GC=GL×2−GL(1+Min), where "RC" is the first correction luminance data, "GC" is the second correction luminance data, "Min" is the sub luminance data, "RL" is the first luminance data, and "GL" is the second luminance data.

In an exemplary embodiment of the inventive concept, the first correction luminance data is RC=RL×2−RL(1+GL) and the second correction luminance data is GC=GL×2−GL(1+RL), where "RC" is the first correction luminance data, "GC" is the second correction luminance data, "Min" is the sub luminance data, "RL" is the first luminance data, and "GL" is the second luminance data.

In an exemplary embodiment of the inventive concept, the first color light is a yellow light and the second color light is a blue light, and the first color filter transmits a red light and the second color filter transmits a green light.

An exemplary embodiment of the inventive concept provides a gamma mapping unit, comprising: a gamma correction unit configured to generate first and second luminance data in response to first and second gray scale data; a sub luminance generation unit configured to generate sub luminance data in response to the first and second luminance data; a first correction unit configured to generate sub correction luminance data in response to the sub luminance data; a second correction unit configured correct the first luminance data using the sub luminance data or the second luminance data to generate first correction luminance data, and to correct the second luminance data using the sub luminance data or the first luminance data to generate second correction luminance data; and an inverse gamma correction unit configured to perform inverse gamma correction on the first and second correction luminance data and the sub correction luminance data to generate first and second correction gray scale data and sub correction gray scale data.

BRIEF DESCRIPTION OF THE FIGURES

The above and other features of the inventive concept will become apparent by describing in detail exemplary embodiments thereof with reference to the following figures, wherein.

DETAILED DESCRIPTION OF THE EMBODIMENTS

Figure 1:
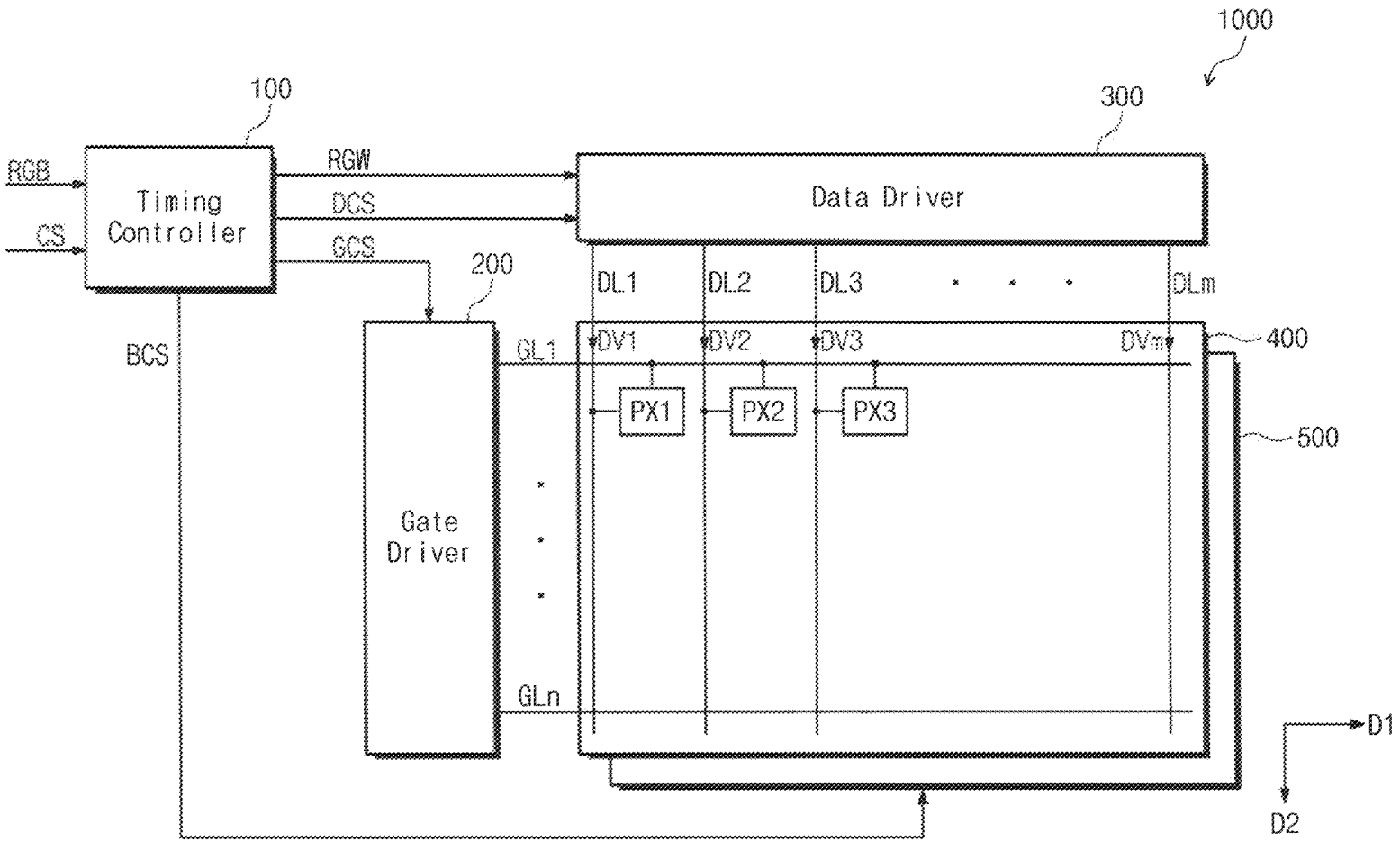
FIG. 1 is a block diagram schematically illustrating a liquid crystal display apparatus according to an exemplary embodiment of the inventive concept.

Exemplary embodiments of the inventive concept will be described in detail with reference to the accompanying drawings. The inventive concept, however, may be embodied in various different forms, and should not be construed as being limited only to the illustrated embodiments. Like reference numerals may denote like elements throughout the attached drawings and written description, and thus descriptions may not be repeated. In the drawings, the sizes and relative sizes of layers and regions may be exaggerated for clarity.

As used herein, the singular forms "a", "an" and "the" are intended to include the plural forms as well, unless the context clearly indicates otherwise. It will be understood that when an element or layer is referred to as being "on", "connected to", "coupled to", or "adjacent to" another element or layer, it can be directly on, connected, coupled, or adjacent to the other element or layer, or intervening elements or layers may be present.

FIG. 1 is a block diagram schematically illustrating a liquid crystal display apparatus according to an exemplary embodiment of the inventive concept.

Referring to FIG. 1, a liquid crystal display apparatus 1000 according to an exemplary embodiment of the inventive concept includes a liquid crystal display panel 400 to display an image, a gate driver 200 and a data driver 300 to drive the liquid crystal display panel 400, and a timing controller 100 to control the gate driver 200 and the data driver 300.

The timing controller 100 receives image information RGB and a plurality of control signals CS from the outside of the liquid crystal display apparatus 1000. The timing controller 100 converts a data format of the image information RGB to be suitable for the interface specifications of the data driver 300 and generates image data RGW as the conversion result. The image data RGW is provided to the data driver 300. The timing controller 100 generates a data control signal DCS (e.g., including an output start signal, a horizontal start signal, and the like) and a gate control signal GCS (e.g., including a vertical start signal, a vertical clock signal, and a vertical clock bar signal) based on the control signals CS. The data control signal DCS is provided to the data driver 300, and the gate control signal GCS is provided to the gate driver 200.

The gate driver 200 sequentially outputs gate signals in response to the gate control signal GCS from the timing controller 100.

The data driver 300 converts the image data RGW into data voltages in response to the data control signal DCS from the timing controller 100. The data voltages thus converted include a plurality of data voltages DV1 to DVm that are provided to the liquid crystal display panel 400.

The liquid crystal display panel 400 includes a plurality of gate lines GL1 to GLn, a plurality of data lines DL1 to DLm, and a plurality of pixels.

The gate lines GL1 to GLn are extended in a first direction D1 and are arranged in parallel with one another in a second direction D2 perpendicular to the first direction D1. The gate lines GL1 to GLn are connected to the gate driver 200 and receive the gate signals from the gate driver 200.

The data lines DL1 to DLm are extended in the second direction D2 and are arranged in parallel with one another in the first direction D1. The data lines DL1 to DLm are connected to the data driver 300 and receive the data voltages DV1 to DVm from the data driver 300.

The pixels include first to third pixels PX1 to PX3 that display different colors. The first to third pixels PX1 to PX3 are spaced apart from one another along the first direction D1. Each of the first to third pixels PX1 to PX3 may include a thin film transistor and a liquid crystal capacitor.

Each of the first to third pixels PX1 to PX3 may be connected to a corresponding one of the gate lines GL1 to GLn and to a corresponding one of the data lines DL1 to DLm. The first to third pixels PX1 to PX3 may be driven independently.

For example, the first pixel PX1 is connected to the first gate line GL1 and the first data line DL1 and receives a corresponding gate signal and a first data voltage DV1. When turned on by the corresponding gate signal, the first pixel PX1 displays an image with a gray scale corresponding to the first data voltage DV1.

The second pixel PX2 is connected to the second gate line GL2 and the second data line DL2 and receives a corresponding gate signal and a second data voltage DV2. When turned on by the corresponding gate signal, the second pixel PX2 displays an image with a gray scale corresponding to the second data voltage DV2.

The third pixel PX3 is connected to the third gate line GL3 and the third data line DL3 and receives a corresponding gate signal and a third data voltage DV3. When turned on by the corresponding gate signal, the third pixel PX3 displays an image with a gray scale corresponding to the third data voltage DV3.

As illustrated in FIG. 1, the liquid crystal display apparatus 1000 according to an exemplary embodiment of the inventive concept further comprises a backlight unit 500 that is placed on the back side of the liquid crystal display panel 400. The timing controller 100 provides the backlight unit 500 with a backlight control signal BCS. The backlight unit 500 generates a light in response to the backlight control signal BCS and supplies the light to the liquid crystal display panel 400.

In an exemplary embodiment of the inventive concept, the backlight unit 500 may use a plurality of light emitting diodes (not shown) as a light source. The light emitting diodes may be arranged on a printed circuit board to have a stripe shape along one direction or to have a matrix shape.

Figure 2:
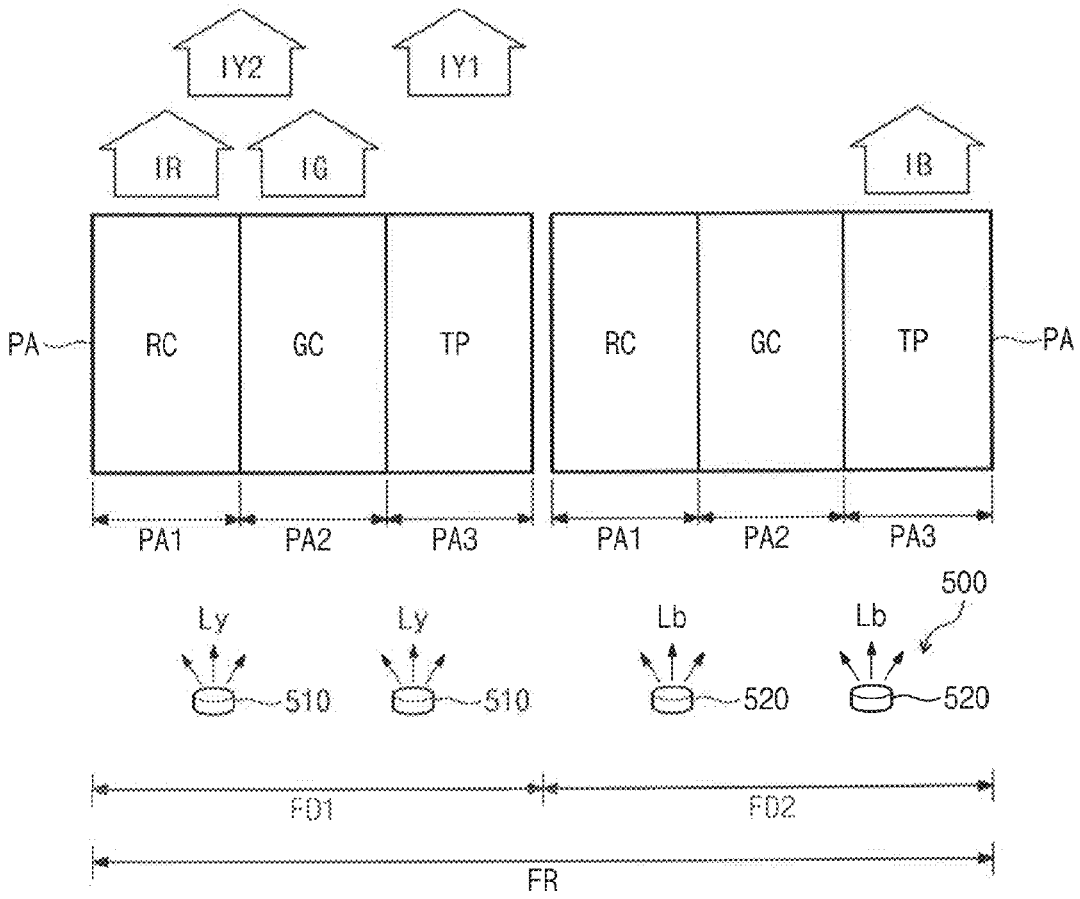
FIG. 2 is a diagram for describing full color expression using a time/spatial division method, according to an exemplary embodiment of the inventive concept.

FIG. 2 is a diagram for describing full color expression using a time/spatial division method, according to an exemplary embodiment of the inventive concept.

Referring to FIG. 2, it is assumed that areas of a liquid crystal display panel 100 (refer to FIG. 1) corresponding to first to third pixels PX1 to PX3 are referred to as first to third pixel areas PA1 to PX3. With this assumption, first and second color filters are provided in the first and second pixel areas PA1 and PX2, and a transmission portion TP is provided in third pixel area PA3.

In an exemplary embodiment of the inventive concept, the first color filter may include a red color filter RC that transmits a red light, and the second color filter may include a green color filter GC that transmits a green light. Since the transmission portion TP does not include a color filter, a light incident to the transmission portion TP is passed without filtering.

A backlight unit 500 (refer to FIG. 1) includes a first light source 510 to generate a first color light and a second light source 520 to generate a second color light.

A frame FR is divided into first and second fields FD1 and FD2 according to a temporal order. As the first light source 510 is driven during a period corresponding to the first field FD1, the first color light is output from the backlight unit 500. The first color light is provided to the liquid crystal display panel 400. Afterwards, as the second light source 520 is driven during a period corresponding to the second field FD2, the second color light is output from the backlight unit 500. The second color light is provided to the liquid crystal display panel 400.

In an exemplary embodiment of the inventive concept, the first color light may be a yellow light Ly, and the second color light may be a blue light Lb. If the first color light is the yellow light Ly, it may include red-light and green-light components. The intensity of the blue light Lb is stronger than that of the yellow light Ly.

During the period corresponding to the first field FD1, a red-light component of the yellow light Ly generated by the backlight unit 500 penetrates the red color filter RC to be displayed as a red image IR. In addition, a green-light component of the yellow light Ly passes the green color filter GC to be displayed as a green image IG. The yellow light Ly penetrates the transmission portion TP to be displayed as a first yellow image IY1.

During the period corresponding to the second filed FD2, the blue light Lb passes the transmission portion TP to be displayed as a blue image IB. However, the blue image IB is not displayed through the first and second pixel areas PA1 and PA2 because it does not pass the first and second color filters RC and GC.

In view of the above description, the first yellow image IY1 is displayed via the transmission portion TP during the first field FD1, and the blue image IB is displayed via the transmission portion TP during the second filed FD2. Since the transmission portion TP does not include a color filter, it passes the first and second color lights Ly and Lb without light loss due to a color filter. Thus, light efficiency of the liquid crystal display apparatus 1000 may be increased.

If the red and green images IR and IG are displayed together via the first and second pixels PX1 and PX2, red and green colors of the red and green images IR and IG are mixed such that a user recognizes a yellow color. Below, an image displayed with the yellow color, which is recognized by the mixing of the red and green images IR and IG, is referred to as a second yellow image IY2. Luminance of the second yellow image IY2 may be decided by one, having a relatively low value, from among luminances of the red and green images IR and IG. A color reproduction range and luminance of the liquid crystal display apparatus 1000 are increased by changing luminance values of the first and second yellow images IY1 and IY2.

Figure 3:
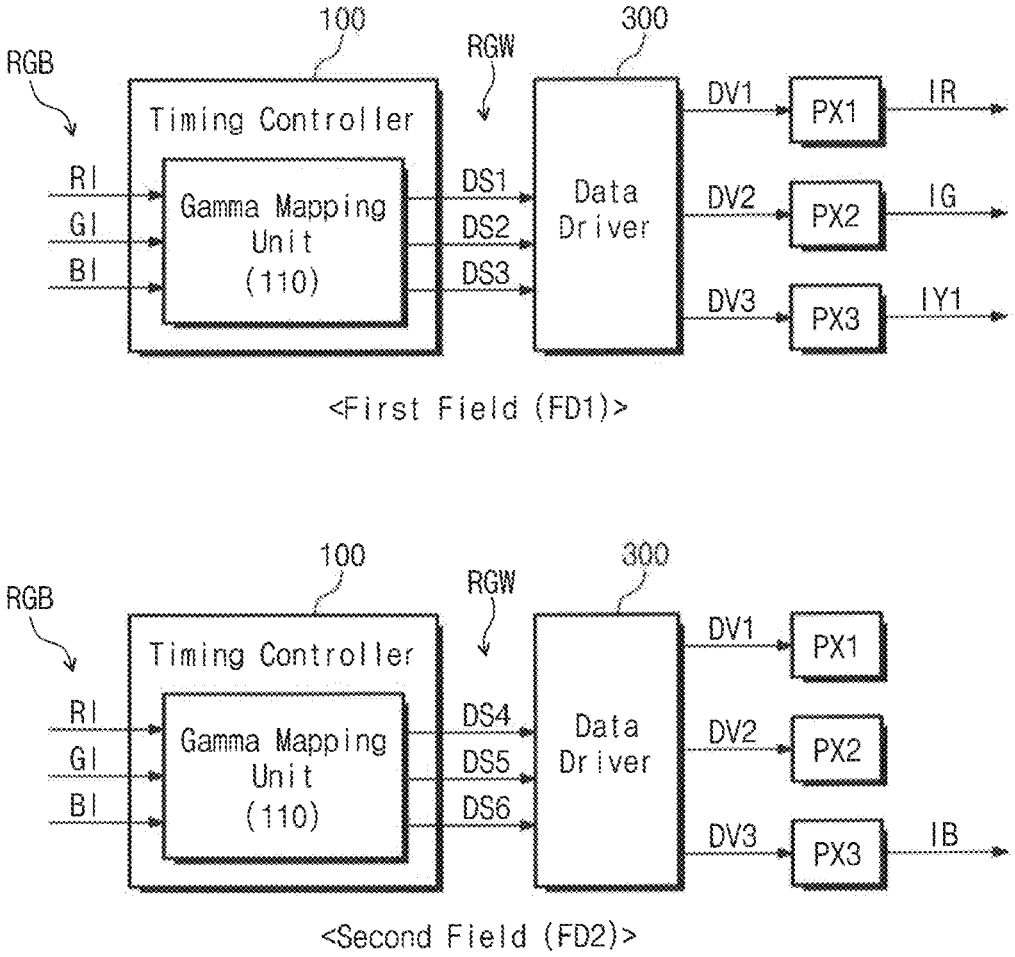
FIG. 3 is a block diagram schematically illustrating an operation of a liquid crystal display apparatus in first and second fields, according to an exemplary embodiment of the inventive concept.

FIG. 3 is a block diagram schematically illustrating an operation of a liquid crystal display apparatus in first and second fields, according to an exemplary embodiment of the inventive concept.

Referring to FIG. 3, a timing controller 100 includes a gamma mapping unit 110.

The gamma mapping unit 110 generates image data RGW based on image information RGB. For example, the gamma mapping unit 110 converts the image information RGB into the image data RGW using color gamut mapping functions. The image data RGW may enable the first to third pixels PX1 to PX3 to display an image based on different color lights in first and second fields FD1 and FD2.

The image information RGB includes first to third gray scale data RI, GI, and BI corresponding to red, green, and blue primary-color spaces. For example, the first gray scale data RI includes information of a gray scale value of a red image IR (refer to FIG. 2), the second gray scale data GI includes information of a gray scale value of a green image IG (refer to FIG. 2), and the third gray scale data BI includes information of a gray scale value of a blue image IB (refer to FIG. 2). The first to third gray scale data RI, GI, and BI may, for example, have a digital value between 0 and 255.

The image data RGW includes first to sixth data signals DS1 to DS6. The first to third data signals DS1 to DS3 are used to drive the first to third pixels PX1 to PX3 during the first field FD1. The fourth to sixth data signals DS4 to DS4 are used to drive the first to third pixels PX1 to PX3 during the second field FD2.

The gamma mapping unit 110 generates the first to third data signals DS1 to DS3 in the first field FD1. The first to third data signals DS1 to DS3 are converted into first to third data voltages DV1 to DV3 through a data driver 300. The first to third data voltages DV1 to DV3 are provided to the first to third pixels PX1 to PX3 during the first field FD1, respectively.

In view of the above description, during the first field FD1, the first pixel PX1 generates the red image IR corresponding to the first data voltage DV1, the second pixel PX2 generates the green image IG corresponding to the second data voltage DV2, and the third pixel PX3 generates a first yellow image IY1 corresponding to the third data voltage DV3.

The gamma mapping unit 110 generates the fourth to sixth data signals DS4 to DS6 in the second field FD2. The gamma mapping unit 110 outputs the fourth, fifth, and sixth data signals DS4, DS5, and DS6 to the data driver 300. The fourth, fifth, and sixth data signals DS4, DS5, and DS6 are converted into first to third data voltages DV1 to DV3 through the data driver 300. The first to third data voltages DV1 to DV3 are provided to the first to third pixels PX1 to PX3 during the second field FD2, respectively.

Thus, the third pixel PX3 generates the blue image IB in response to the third data voltage DV3. For the reasons described above, an image is not displayed via the first and second pixels PX1 and PX2 during the second field FD2.

Figure 4:
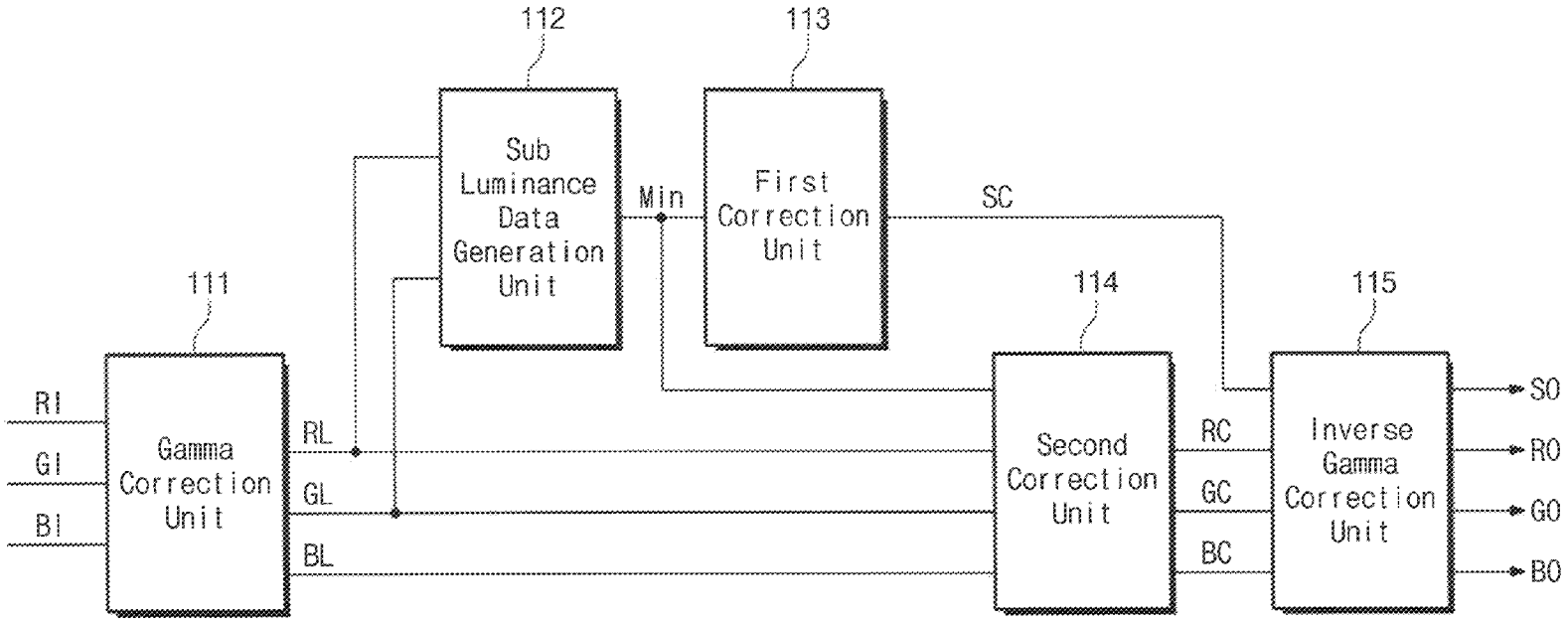
FIG. 4 is a block diagram schematically illustrating a gamma mapping unit according to an exemplary embodiment of the inventive concept.
Figure 5:
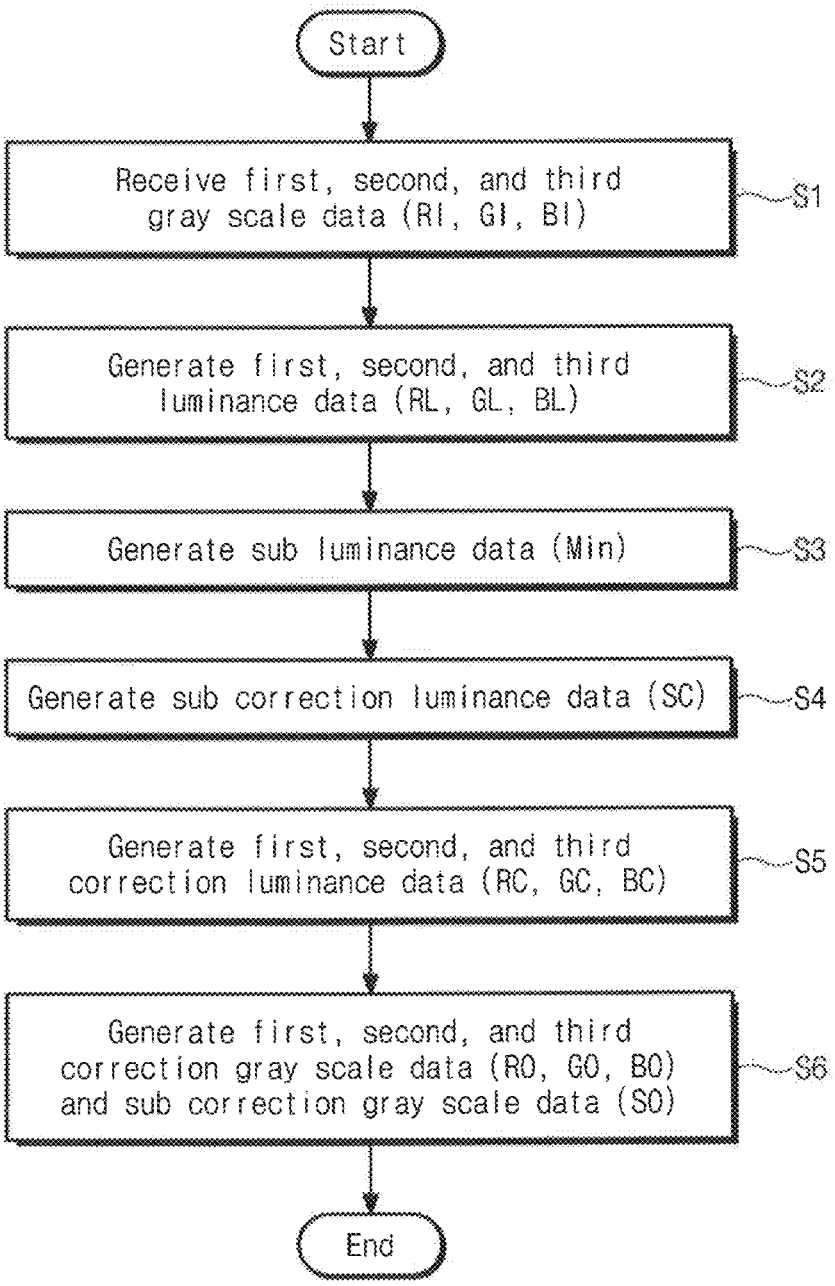
FIG. 5 is a flow chart schematically illustrating an operating procedure of a gamma mapping unit shown in FIG. 4, according to an exemplary embodiment of the inventive concept.

FIG. 4 is a block diagram schematically illustrating a gamma mapping unit according to an exemplary embodiment of the inventive concept. FIG. 5 is a flow chart schematically illustrating an operating procedure of a gamma mapping unit shown in FIG. 4, according to an exemplary embodiment of the inventive concept.

Referring to FIGS. 2, 4, and 5, a gamma mapping unit 110 includes a gamma correction unit 111, a sub luminance data generation unit 112, a first correction unit 113, a second correction unit 114, and an inverse gamma correction unit 115.

The gamma correction unit 111 receives first to third gray scale data RI, GI, and BI an external device (S1). The gamma correction unit 111 generates first, second, and third luminance data RL, GL, and BL based on the first to third gray scale data RI, GI, and BI (S2).

For example, the gamma correction unit 111 gamma-corrects the first to third gray scale data RI, GI, and BI to generate the first, second, and third luminance data RL, GL, and BL. The first luminance data RL includes luminance information of a red image IR, the second luminance data GL includes luminance information of a green image IG, and the blue luminance data BL includes luminance information of a blue image IB.

The gamma correction unit 111 generates the first luminance data RL by gamma-correcting the first gray scale data RI according to the following equation (1).

$$RL = \left(\frac{RI}{255}\right)^{\gamma 1} \tag{1}$$

In the equation (1), "RL" is the first luminance data, "RI" is the first gray scale data, and "γ1" is a first gamma value. The first gamma value γ1 may be varied according to a gamma characteristic. The first gamma value γ1 may have a value of 2.2, for example.

Since the first gray scale data RI has a value between 0 and 255, the first luminance data RL generated via the equation (1) may have a value between 0 and 1.

The gamma correction unit 111 generates the second and third luminance data GL and BL by gamma-correcting the second and third gray scale data GI and BI according to the following equations (2, 3).

$$GL = \left(\frac{GI}{255}\right)^{\gamma 1} \quad (2)$$

$$BL = \left(\frac{BI}{255}\right)^{\gamma 1} \quad (3)$$

In the equations (2, 3), "GL" is the second luminance data, "BL" is the third luminance data, "GI" is the second gray scale data, and "BI" is the third gray scale data.

Since the second and third gray scale data GI and BI have a value between 0 and 255, the second and third luminance data GL and BL generated via the equations (2, 3) may have a value between 0 and 1.

The sub luminance data generation unit 112 receives the first and second luminance data RL and GL from the gamma correction unit 111. The sub luminance data generation unit 112 generates sub luminance data Min based on the first and second luminance data RL and GL (S3).

The sub luminance data generation unit 112 generates the sub luminance data Min based on a smaller one of values of the first and second luminance data RL and GL. The sub luminance data Min includes original information about luminance of a first yellow image IY1. Since the first and second luminance data RL and GL have a value between 0 and 1, the sub luminance data Min also has a value between 0 and 1.

The first correction unit 113 generates sub correction luminance data SC based on the sub luminance data Min received from the sub luminance data generation unit 112 (S4). Luminance of the first yellow image IY1 is decided by the sub correction luminance data SC.

The first correction unit 113 generates the sub correction luminance data SC by correcting the sub luminance data Min using a second gamma value γ2. For example, the first correction unit 113 generates the sub correction luminance data SC by correcting the sub luminance data Min according to the following equation (4).

$$SC = Min^{\gamma 2/\gamma 1} \quad (4)$$

In the equation (4), "SC" is the sub correction luminance data, "Min" is the sub luminance data, "γ1" is the first gamma value, and "γ2" is the second gamma value.

The second gamma value γ2 is larger than the first gamma value γ1. For example, the second gamma value γ2 may satisfy the following equation (5).

$$1.2 < \gamma 2/\gamma 1 < 2 \quad (5)$$

If the sub luminance data Min is corrected using the second gamma value γ2 is larger than the first gamma value γ1, a luminance value at an intermediate gray scale of the sub correction luminance data SC is smaller than that at an intermediate gray scale of the sub luminance data Min. Thus, luminance corresponding to an intermediate gray scale of the first yellow image IY1 is reduced.

The second correction unit 114 receives the first, second, and third luminance data RL, GL, and BL from the gamma correction unit 111 and the sub luminance data Min from the sub luminance data generation unit 112. The second correction unit 114 generates first to third correction luminance data RC, GC, and RC (S5).

The first correction luminance data RC is generated by correcting the first luminance data RL using at least one of the second luminance data GL and the sub luminance data Min.

For example, the first correction luminance data RC is generated using the following equation (6).

$$RC = RL \times (1 - GL) + Min \quad (6)$$

In the equation (6), "RC" is the first correction luminance data, "RL" is the first luminance data, "GL" is the second luminance data and "Min" is the sub luminance data.

The second correction luminance data GC is generated by correcting the second luminance data GL using at least one of the first luminance data RL and the sub luminance data Min.

For example, the second correction luminance data GC is generated using the following equation (7).

$$GC = GL \times (1 - RL) + Min \quad (7)$$

In the equation (7), "GC" is the second correction luminance data, "RL" is the first luminance data, "GL" is the second luminance data and "Min" is the sub luminance data.

The third correction luminance data RC is generated by correcting the third luminance data BL using the sub luminance data Min.

For example, the third correction luminance data RC is generated using the following equation (8).

$$RC = 0.5 \times BL \times (1 + Min) \quad (8)$$

In the equation (8), "RC" is the third correction luminance data, "BL" is the third luminance data and "Min" is the sub luminance data.

The inverse gamma correction unit 115 receives the first to third correction luminance data RC, GC, and RC from the second correction unit 114 and the sub correction luminance data SC from the first correction unit 113.

The inverse gamma correction unit 115 generates first to third correction gray scale data RO, GO, and BO and sub correction gray scale data SO by performing inverse gamma correction on the first to third correction luminance data RC, GC, and RC and the sub correction luminance data SC (S6).

For example, the inverse gamma correction unit 115 generates the first correction gray scale data RO by performing inverse gamma correction on the first correction luminance data RC using the first gamma value γ1 as expressed by the following equation (9).

$$RO = (255 \times RC)^{1/\gamma 1} \quad (9)$$

In the equation (9), "RO" is the first correction gray scale data, "RC" is the first correction luminance data and "γ1" is the first gamma value.

Likewise, the inverse gamma correction unit 115 generates the second correction gray scale data GO by performing inverse gamma correction on the second correction luminance data GC, the third correction gray scale data BO by performing inverse gamma correction on the third correction luminance data RC, and the sub correction gray scale data SO by performing inverse gamma correction on the sub correction luminance data SC as expressed by the following equations (10) to (12).

$$GO = (255 \times GC)^{1/\gamma 1} \quad (10)$$

$$BO = (255 \times 80)^{1/\gamma 1} \quad (11)$$

$$SO = (255 \times SC)^{1/\gamma 1} \quad (12)$$

In the equations (10) to (12), "GO" is the second correction gray scale data, "BO" is the third correction gray scale data, "SO" is the sub correction gray scale data, "GC" is the second correction luminance data, "RC" is the third correction luminance data, "SC" is the sub correction luminance data and "γ1" is the first gamma value.

Referring to FIGS. 3 and 4, during the first field FD1, the gamma mapping unit 110 outputs the first correction gray scale data RO, the second correction gray scale data GO, and the sub correction gray scale data SO to the data driver 300 as the first data signal DS1, the second data signal DS2, and the third data signal DS3. Thus, during the first field FD1, the first pixel PX1 displays the red image IR having luminance corresponding to the first correction gray scale data RO, the second pixel PX2 displays the green image IG having luminance corresponding to the second correction gray scale data GO, and the third pixel PX3 displays the first yellow image IY1 having luminance corresponding to the sub correction gray scale data SO.

During the second field FD2, the gamma mapping unit 110 provides the data driver 300 with the third correction gray scale data BO as the sixth data signal DS6 (refer to FIG. 3). At this time, the third pixel PX3 displays the blue image IB having luminance corresponding to the third correction gray scale data BO.

During the second field FD2, the gamma mapping unit 110 provides the data driver 300 with the first correction gray scale data RO as the fourth data signal DS4. In addition, during the second field FD2, the gamma mapping unit 110 provides the data driver 300 with the second correction gray scale data GO as the fifth data signal DS5. As described above, the first correction unit 113 generates the sub correction luminance data SC by decreasing a luminance value at an intermediate gray scale of the sub luminance data Min using the equation (4). As there is decreased luminance corresponding to an intermediate gray scale of the first yellow image IY1 generated according to the sub correction luminance data SC, a gray scale difference between the first yellow image IY1 and the blue image IB is reduced.

In other words, as there is reduced a difference between a gray scale of the third pixel PX3 in the first field FD1 and a gray scale of the third pixel PX3 in the second field FD2, there is shortened a time taken to rearrange liquid crystal molecules in the third pixel PX3 in the first and second fields FD1 and FD2. Since a light is radiated from a backlight unit 500 (refer to FIG. 1) after the liquid crystal molecules are sufficiently rearranged, a gray scale is displayed in the first and second fields FD1 and FD2 in the same way. Thus, a color reproduction range of a liquid crystal display apparatus 1000 (refer to FIG. 1) is increased.

In addition, as the liquid crystal molecules are sufficiently rearranged, transmittance is sufficiently secured. If a light is radiated from the backlight unit 500 under such a condition, the whole luminance of the liquid crystal display apparatus 1000 is increased.

If the second correction unit 114 generates the first and second correction luminance data RC and GC according to the equations (6) and (7), it is possible to compensate for decreased luminance of the first yellow image IY1 using the second yellow image IY2 (refer to FIG. 3). This will be more fully described with reference to FIG. 6.

Figure 6:
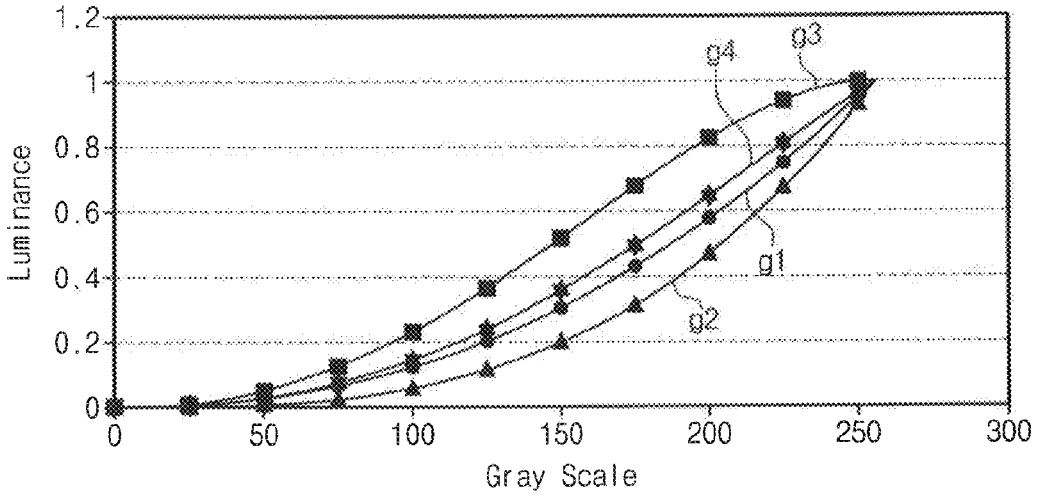
FIG. 6 is a graph showing a gamma curve of a liquid crystal display apparatus according to an exemplary embodiment of the inventive concept.

FIG. 6 is a graph showing a gamma curve of a liquid crystal display apparatus according to an exemplary embodiment of the inventive concept. In FIG. 6, an x-axis indicates a gray scale value, and a y-axis indicates a luminance value.

Referring to FIG. 6, a first gamma curve g1 is a gamma curve when sub luminance data Min is gamma-corrected using a gamma value of 2.2. A second gamma curve g2 is a gamma curve of a first yellow image IY1, and a third gamma curve g3 is a gamma curve of a second yellow image IY2. A fourth gamma curve g4 is a gamma curve when the first yellow image IY1 and the second yellow image IY2 are added to each other.

Luminance corresponding to an intermediate gray scale of the first yellow image IY1 is lower than that corresponding to an intermediate gray scale when the sub luminance data Min is gamma-corrected using a second gamma value γ2. Thus, the second gamma curve g2 is placed below the first gamma curve g1.

Luminance corresponding to an intermediate gray scale of the second yellow image IY2 is higher than that corresponding to an intermediate gray scale when the sub luminance data Min is gamma-corrected using a first gamma value γ1. Thus, the third gamma curve g3 is placed above the first gamma curve g1.

Luminance of the second yellow image IY2 compensates for reduced luminance of the first yellow image IY1 Thus, luminance when the second yellow image IY2 and the first yellow image IY1 are added to each other converges with luminance when the sub luminance data Min is gamma-corrected using the second gamma value γ2. In other words, the fourth gamma curve g4 converges with the first gamma curve g1.

Above is described an example in which first and second luminance data RL and GL are corrected according to the equations (6) and (7). However, the inventive concept is not limited thereto. For example, the first and second luminance data RL and GL may be corrected according to various equations that enable the fourth gamma curve g4 to converge with the first gamma curve g1.

For example, the first and second luminance data RL and GL may be corrected according to the following equations (13) and (14).

$$RC'=RL\times(1-\text{Min})+\text{Min} \tag{13}$$

$$GC'=GL\times(1-\text{Min})+\text{Min} \tag{14}$$

In the equations (13) and (14), "RC'" is the first correction luminance data, "GC'" is the second correction luminance data, "RL" is the first luminance data, "GL" is the second luminance data and "Min" is the sub luminance data.

Figure 7:
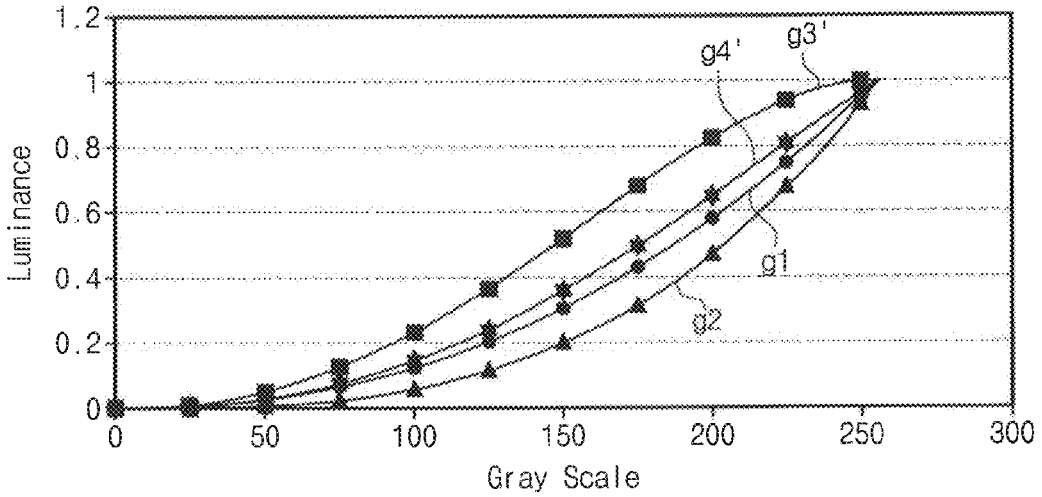
FIG. 7 is a graph showing a gamma curve of a liquid crystal display apparatus according to an exemplary embodiment of the inventive concept.

FIG. 7 is a graph showing a gamma curve of a liquid crystal display apparatus according to an exemplary embodiment of the inventive concept. A third gamma curve g3' is a gamma curve of a second yellow image IY2 that is generated based on first and second luminance data RL' and GL'. A fourth gamma curve g4' is a gamma curve when the first yellow image IY1 and the second yellow image IY2 are added to each other. In FIG. 7, first and second gamma curve g1 and g2 are equal to the first and second gamma curves g1 and g2 shown in FIG. 6.

Referring to FIG. 7, when the second yellow image IY2 is generated based on the first and second correction luminance data RC and GC', luminance of the second yellow image IY2 is higher than that when sub luminance data Min is gamma-corrected using a first gamma value γ1. Thus, the third gamma curve g3' being a gamma curve of the second yellow image IY2 is placed above the first gamma curve g1.

Luminance of the second yellow image IY2 compensates for reduced luminance of the first yellow image IY1. Thus, luminance when the second yellow image IY2 and the first yellow image IY1 are added to each other converges with luminance when the sub luminance data Min is gamma-corrected using the first gamma value γ1. In this case, the fourth gamma curve g4' converges with the first gamma curve g1.

In addition, the first and second luminance data RL and GL may be corrected according to the following equations (15) and (16).

$$RC''=RL\times 2-RL(1+\mathrm{Min}) \quad (15)$$

$$GC''=GL\times 2-GL(1+\mathrm{Min}) \quad (16)$$

In the equations (15) and (16), "RC'" is the first correction luminance data, "GC'" is the second correction luminance data, "RL" is the first luminance data, "GL" is the second luminance data and "Min" is the sub luminance data.

Figure 8:
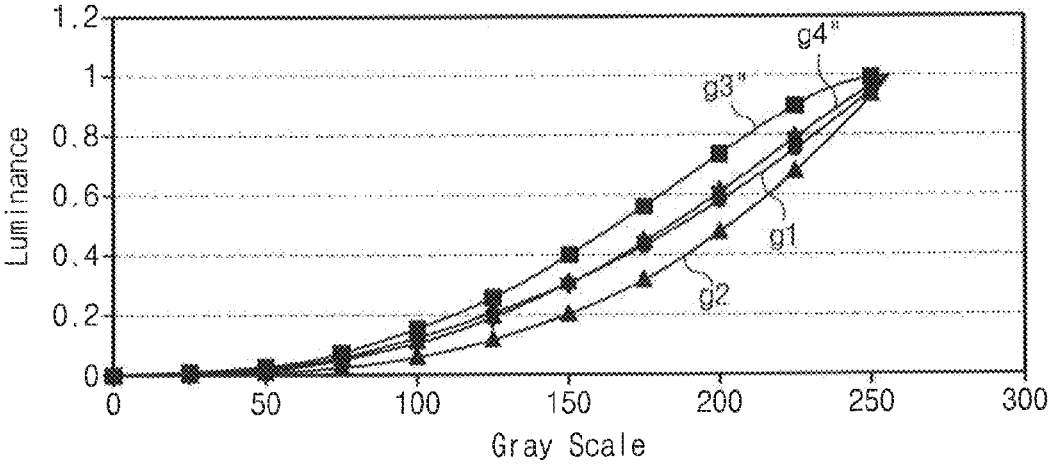
FIG. 8 is a graph showing a gamma curve of a liquid crystal display apparatus according to an exemplary embodiment of the inventive concept.

FIG. 8 is a graph showing a gamma curve of a liquid crystal display apparatus according to an exemplary embodiment of the inventive concept. A third gamma curve g3" is a gamma curve of a second yellow image IY2 that is generated based on first and second luminance data RL" and GL". A fourth gamma curve g4" is a gamma curve when the first yellow image IY1 and the second yellow image IY2 are added to each other. In FIG. 8, first and second gamma curve g1 and g2 are equal to the first and second gamma curves g1 and g2 shown in FIG. 6.

Referring to FIG. 8, when the second yellow image IY2 is generated based on first and second correction luminance data RC" and GC", luminance of the second yellow image IY2 is higher than that when sub luminance data Min is gamma-corrected using a first gamma value γ1. Thus, the third gamma curve g3" being a gamma curve of the second yellow image IY2 is placed above the first gamma curve g1.

Luminance of the second yellow image IY2 compensates for reduced luminance of the first yellow image IY1. Thus, luminance when the second yellow image IY2 and the first yellow image IY1 are added to each other converges with luminance when the sub luminance data Min is gamma-corrected using the first gamma value γ1. In this case, the fourth gamma curve g4" converges with the first gamma curve g1.

In addition, the first and second luminance data RL and GL may be corrected according to the following equations (17) and (18).

$$RC'''=RL\times 2-RL(1+GL) \quad (17)$$

$$GC'''=GL\times 2-GL(1+RL) \quad (18)$$

In the equations (17) and (18), "RC'" is the first correction luminance data, "GC'" is the second correction luminance data, "RL" is the first luminance data, and "GL" is the second luminance data.

Figure 9:
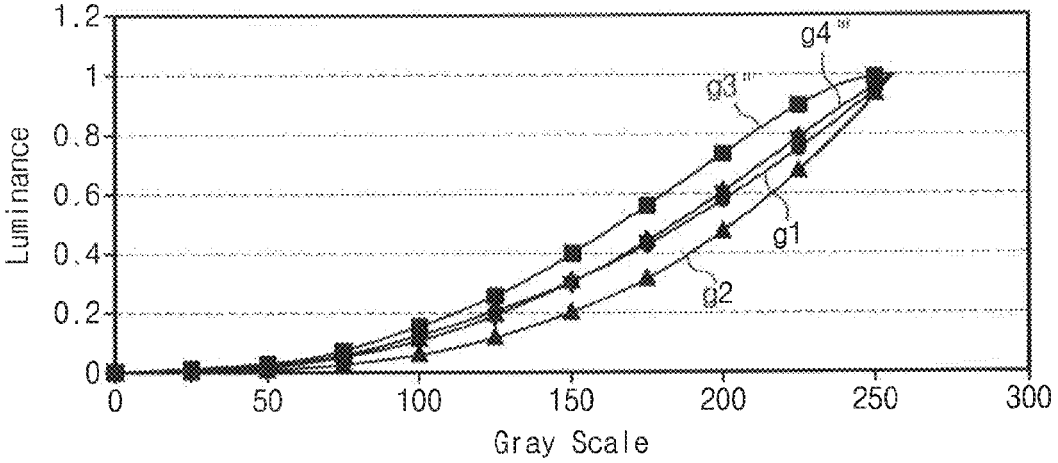
FIG. 9 is a graph showing a gamma curve of a liquid crystal display apparatus according to an exemplary embodiment of the inventive concept.

FIG. 9 is a graph showing a gamma curve of a liquid crystal display apparatus according to an exemplary embodiment of the inventive concept. A third gamma curve g3'" is a gamma curve of a second yellow image IY2 that is generated based on first and second luminance data RL'" and GL'". A fourth gamma curve g4'" is a gamma curve when the first yellow image IY1 and the second yellow image IY2 are added to each other. In FIG. 9, first and second gamma curve g1 and g2 are equal to the first and second gamma curves g1 and g2 shown in FIG. 6.

Referring to FIG. 9, when the second yellow image IY2 is generated based on first and second correction luminance data RC'" and GC'", luminance of the second yellow image IY2 is higher than that when sub luminance data Min is gamma-corrected using a first gamma value γ1. Thus, the third gamma curve g3'" being a gamma curve of the second yellow image IY2 is placed above the first gamma curve g1.

Luminance of the second yellow image IY2 compensates for reduced luminance of the first yellow image IY1. Thus, luminance when the second yellow image IY2 and the first yellow image IY1 are added to each other converges with luminance when the sub luminance data Min is gamma-corrected using the first gamma value γ1. In this case, the fourth gamma curve g4'" converges with the first gamma curve g1.

While the inventive concept has been shown and described with reference to exemplary embodiments thereof, it will be apparent to those of ordinary skill in the art that various changes in form and detail may be made thereto without departing from the spirit and scope of the inventive concept as defined by the following claims.

What is claimed is:

1. A method of driving a liquid crystal display apparatus which includes a liquid crystal display panel including a first pixel having a first color filter, a second pixel having a second color filter having a color different from a color of the first color filter, and a third pixel having a transmission portion, the method comprising:

providing the liquid crystal display panel with a first color light having a first color and a second color light having a second color different from the first color during a first field and a second field of a time-divided frame;

gamma-correcting first and second gray scale data received from an external device using a first gamma value to generate first and second luminance data;

generating sub luminance data based on a smaller value of the first and second luminance data;

correcting the sub luminance data using a second gamma value larger than the first gamma value to generate sub correction luminance data;

correcting the first luminance data using the sub luminance data or the second luminance data to generate first correction luminance data;

correcting the second luminance data using the sub luminance data or the first luminance data to generate second correction luminance data;

inverse gamma-correcting the first and second correction luminance data and the sub correction luminance data using the first gamma value to generate first and second correction gray scale data and sub correction gray scale data; and providing the first pixel, second pixel, and third pixel with the first correction gray scale data, second correction gray scale data, and sub correction gray scale data during the first field.

2. The method of claim 1, wherein the sub correction luminance data is generated by:

$$SC=\mathrm{Min}^{\gamma 2/\gamma 1},$$

where "SC" is the sub correction luminance data, "Min" is the sub luminance data, "γ1" is the first gamma value, and "γ2" is the second gamma value.

3. The method of claim 1, wherein the first and second gamma values satisfy a condition: 1 $0.2<\gamma 2/\gamma 1<2$, where "γ1" is the first gamma value, and "γ2" is the second gamma value.

4. The method of claim 1, wherein the first correction luminance data is $RC=RL\times(1-GL)+\mathrm{Min}$ and the second correction luminance data is $GC=GL\times(1-RL)+\mathrm{Min}$, where "RC" is the first correction luminance data, "GC" is the second correction luminance data, "Min" is the sub luminance data, "RL" is the first luminance data, and "GL" is the second luminance data.

5. The method of claim 1, wherein the first correction luminance data is $RC=RL\times(1-\mathrm{Min})+\mathrm{Min}$ and the second correction luminance data is $GC=GL\times(1-\mathrm{Min})+\mathrm{Min}$, where "RC" is the first correction luminance data, "GC" is the second correction luminance data, "Min" is the sub luminance data, "RL" is the first luminance data, and "GL" is the second luminance data.

6. The method of claim 1, wherein the first correction luminance data is RC=RL×2−RL(1+Min) and the second correction luminance data is GC=GL×2−GL(1+Min), where "RC" is the first correction luminance data, "GC" is the second correction luminance data, "Min" is the sub luminance data, "RL" is the first luminance data, and "GL" is the second luminance data.

7. The method of claim 1, wherein the first correction luminance data is RC=RL×2−RL(1+GL) and the second correction luminance data is GC=GL×2−GL(1+RL), where "RC" is the first correction luminance data, "GC" is the second correction luminance data, "Min" is the sub luminance data, "RL" is the first luminance data, and "GL" is the second luminance data.

8. The method of claim 1, further comprising:

gamma-correcting third gray scale data received from the external device using the first gamma value to generate third luminance data;

correcting the third luminance data based on the sub luminance data to generate third correction luminance data;

inverse gamma-correcting the third correction luminance data to generate third correction gray scale data; and providing the third pixel with the third correction gray scale data during the second field.

9. The method of claim 8, wherein the third correction luminance data is BC=0.5×BL×(1+Min), where "BC" is the third correction luminance data, "BL" is the third luminance data, and "Min" is the sub luminance data.

10. The method of claim 1, wherein an intensity of the second color light is greater than an intensity of the first color light.

11. The method of claim 1, wherein the first color light is a yellow light and the second color light is a blue light.

12. The method of claim 1, wherein the first color filter transmits a red light and the second color filter transmits a green light.

13. The method of claim 1, further comprising:

providing the first and second pixels with the first and second correction gray scale data during the second field.

14. A liquid crystal display apparatus, comprising:

a backlight unit configured to output a first color light with a first color and a second color light with a second color different from the first color during a first field and a second field of a time-divided frame;

a liquid crystal display panel configured to display an image corresponding to the frame and including a first pixel having a first color filter, a second pixel having a second color filter having a color different from a color of the first color filter, and a third pixel having a transmission portion; and a gamma mapping unit, wherein the gamma mapping unit comprises:

a gamma correction unit configured to gamma-correct first and second gray scale data received from an external device using a first gamma value to generate first and second luminance data;

a sub luminance data generation unit configured to generate sub luminance data based on a smaller value of the first and second luminance data;

a first correction unit configured to correct the sub luminance data using a second gamma value larger than the first gamma value to generate sub correction luminance data;

a second correction unit configured to correct the first luminance data using the sub luminance data or the second luminance data to generate first correction luminance data and to correct the second luminance data using the sub luminance data or the first luminance data to generate second correction luminance data; and an inverse gamma correction unit configured to perform inverse gamma correction on the first and second correction luminance data and the sub correction luminance data using the first gamma value to generate first and second correction gray scale data and sub correction gray scale data, and wherein the gamma mapping unit provides the first pixel, second pixel, and third pixel with the first correction gray scale data, second correction gray scale data, and sub correction gray scale data during the first field.

15. The liquid crystal display apparatus of claim 14, wherein the sub correction luminance data is generated by:

$$SC=Min^{\gamma 2/\gamma 1},$$

where "SC" is the sub correction luminance data, "Min" is the sub luminance data, "γ1" is the first gamma value, and "γ2" is the second gamma value.

16. The liquid crystal display apparatus of claim 14, wherein the first correction luminance data is RC=RL×(1−GL)+Min and the second correction luminance data is GC=GL×(1−RL)+Min, where "RC" is the first correction luminance data, "GC" is the second correction luminance data, "Min" is the sub luminance data, "RL" is the first luminance data, and "GL" is the second luminance data.

17. The liquid crystal display apparatus of claim 14, wherein the first correction luminance data is RC=RL×(1−Min)+Min and the second correction luminance data is GC=GL×(1−Min)+Min, where "RC" is the first correction luminance data, "GC" is the second correction luminance data, "Min" is the sub luminance data, "RL" is the first luminance data, and "GL" is the second luminance data.

18. The liquid crystal display apparatus of claim 14, wherein the first correction luminance data is RC=RL×2−RL(1+Min) and the second correction luminance data is GC=GL×2−GL(1+Min), where "RC" is the first correction luminance data, "GC" is the second correction luminance data, "Min" is the sub luminance data, "RL" is the first luminance data, and "GL" is the second luminance data.

19. The liquid crystal display apparatus of claim 14, wherein the first correction luminance data is RC=RL×2−RL(1+GL) and the second correction luminance data is GC=GL×2−GL(1+RL), where "RC" is the first correction luminance data, "GC" is the second correction luminance data, "Min" is the sub luminance data, "RL" is the first luminance data, and "GL" is the second luminance data.

20. The liquid crystal display apparatus of claim 14, wherein the first color light is a yellow light and the second color light is a blue light, and wherein the first color filter transmits a red light and the second color filter transmits a green light.

21. A gamma mapping unit, comprising:

a gamma correction unit configured to generate first and second luminance data in response to first and second gray scale data;

a sub luminance generation unit configured to generate sub luminance data in response to the first and second luminance data;

a first correction unit configured to generate sub correction luminance data in response to the sub luminance data by correcting the sub luminance data with a second gamma value larger than a first gamma value, wherein the first gamma value is used to generate the first and second luminance data;

a second correction unit configured to correct the first luminance data using the sub luminance data or the second luminance data to generate first correction luminance data, and to correct the second luminance data using the sub luminance data or the first luminance data to generate second correction luminance data; and an inverse gamma correction unit configured to perform inverse gamma correction on the first and second correction luminance data and the sub correction luminance data to generate first and second correction gray scale data and sub correction gray scale data.

* * * * *